US006572422B2

(12) United States Patent
Kirkwood et al.

(10) Patent No.: US 6,572,422 B2
(45) Date of Patent: Jun. 3, 2003

(54) TAIL ASSEMBLY FOR AN UNDERWATER VEHICLE

(75) Inventors: William J. Kirkwood, Carmel, CA (US); Farley Shane, Prunedale, CA (US); Mark Griese, Santa Barbara, CA (US); Douglas Au, Royal Oaks, CA (US); Ed Mellinger, Monterey, CA (US); Thomas O'Reilly, Santa Cruz, CA (US); Joseph Andrew Gashler, Pacific Grove, CA (US); Knut Strietlien, Jamaica Plain, MA (US)

(73) Assignee: Monterey Bay Aquarium Research Institute (MBARI), Moss Landing, CA (US)

( * ) Notice: Subject to any disclaimer, the term of this patent is extended or adjusted under 35 U.S.C. 154(b) by 0 days.

(21) Appl. No.: 09/888,396

(22) Filed: Jun. 26, 2001

(65) Prior Publication Data

US 2002/0049012 A1 Apr. 25, 2002

Related U.S. Application Data

(60) Provisional application No. 60/239,468, filed on Oct. 10, 2000.

(51) Int. Cl.[7] ..... B63H 1/16

(52) U.S. Cl. ..... 440/67; 114/312; 114/315; 114/337

(58) Field of Search ..... 114/312, 315, 114/316, 318, 330, 337, 338, 20.1, 20.2, 21.1, 21.2, 23, 244, 245; 440/49, 66, 67

(56) References Cited

U.S. PATENT DOCUMENTS

| | | | | | |
|---|---|---|---|---|---|
| 3,063,394 | A | * | 11/1962 | Rebikoff | 114/315 |
| 3,104,641 | A | * | 9/1963 | Froehlich | 114/330 |
| 3,162,162 | A | * | 12/1964 | Hamlin et al. | 114/23 |
| 3,356,055 | A | * | 12/1967 | Link | 114/330 |
| 3,416,478 | A | * | 12/1968 | Markham | 114/315 |
| 3,565,028 | A | * | 2/1971 | Hancks et al. | 114/20.1 |
| 3,706,293 | A | * | 12/1972 | Hancks et al. | 114/20.1 |
| 4,424,042 | A | * | 1/1984 | Gongwer | 440/44 |
| 4,996,938 | A | * | 3/1991 | Cameron et al. | 114/315 |
| 5,108,323 | A | * | 4/1992 | Veronesi et al. | 440/53 |
| 5,220,231 | A | * | 6/1993 | Veronesi et al. | 310/90 |
| 5,984,739 | A | * | 11/1999 | Donahue | 440/6 |

FOREIGN PATENT DOCUMENTS

| | | | | |
|---|---|---|---|---|
| EP | 385827 | * | 9/1990 | 114/338 |
| FR | 1277356 | * | 10/1961 | 114/337 |
| JP | 61-178290 | * | 8/1986 | 114/338 |
| JP | 62-283099 | * | 12/1987 | 114/338 |

* cited by examiner

*Primary Examiner*—S. Joseph Morano
*Assistant Examiner*—Ajay Vasudeva
(74) *Attorney, Agent, or Firm*—Oblon, Spivak, McClelland, Maier & Neustadt, P.C.

(57) ABSTRACT

An assembly for an underwater vehicle that includes a motor, a duct assembly, and an actuator. The duct assembly includes a duct and a propeller mounted within the duct, where the propeller is driven by the motor. The actuator is connected to the duct assembly and the vehicle. The actuator pivots the duct assembly with respect to the vehicle. Alternatively, the assembly includes a motor, a duct having a generally cylindrical shape oriented about a longitudinal axis, and a propeller having an axis of rotation. The propeller is mounted within the duct and is driven by the motor. The propeller and the duct are connected such that the axis of rotation and the longitudinal axis have a fixed orientation with respect to one another. The assembly includes a configuration for changing an orientation of the axis of rotation and the longitudinal axis with respect to the vehicle.

36 Claims, 12 Drawing Sheets

TAIL ASSEMBLY FOR AN UNDERWATER VEHICLE

CROSS-REFERENCE TO RELATED APPLICATION

The present application claims priority to Provisional Patent Application Serial No. 60/239,468, which was filed on Oct. 10, 2000.

STATEMENT REGARDING FEDERALLY SPONSORED RESEARCH OR DEVELOPMENT

The present invention was supported in part by contract number N00014-98-1-0814 from the National Ocean Partnership Proposal (NOPP). The U.S. Government has certain rights in the invention.

BACKGROUND OF THE INVENTION

1. Field of the Invention

The present invention relates to propulsion and control of underwater vehicles.

2. Discussion of the Background

Underwater vehicles, such as autonomous under water vehicles (or AUVs), are used to acquire various types of scientific data and water column characteristics in deep sea environments. In order to facilitate the collection of data, AUVs must be configured to include characteristics such as high speed, maneuverability, and energy efficiency, however present AUVs have not sufficiently provided such characteristics.

Known AUV configurations include underwater vehicles having propellers that are mounted to the vehicle such that the propeller rotates on an axis that has a fixed orientation with respect to the body of the AUV. Such AUVS typically include one or more rudder devices that pivot to control the direction of the AUV within the submerged environment. In this configuration the propeller provides forward thrust and the rudder devices directional control by providing wing-like or fin-like structures having surfaces that act against the fluid passing over the rudder devices. This configuration is inherently inefficient since the fluid pressure acting on the rudder devices in order to control the direction of the vehicle is effectively acting against the forward thrust of the propeller, thereby requiring the propeller motor to expend additional energy to steer the AUV. Additionally, the rudder devices are not necessarily the most efficient or accurate manner of controlling the direction of the AUV. Furthermore, the forces acting on the rudder devices require that the wing-like or fin-like structures be constructed of rigid materials that are likely heavier in weight and more expensive to manufacture than might otherwise be necessary.

Therefore, there is a need for a propulsion and control system for an underwater vehicle that is more efficient, more accurate, and less expensive to manufacture than known systems.

SUMMARY OF THE INVENTION

Accordingly, the present invention provides an assembly having an articulated, ducted thruster for improved underwater vehicle control and propulsion.

The present invention advantageously provides an assembly for an underwater vehicle that includes a motor, a duct assembly, and a first actuator. The duct assembly includes a duct and a propeller mounted within the duct, where the propeller is driven by the motor. The first actuator is connected to the duct assembly and is adapted to be connected to the vehicle. The first actuator is advantageously adapted to pivot the duct assembly with respect to the vehicle. Preferably, the assembly further includes a coupling member mounted to the vehicle and configured to pivotally receive a portion of the duct assembly, where the duct assembly is configured to pivot within the coupling member. Additionally, the assembly preferably includes a second actuator mounted to the vehicle, where the second actuator is connected to the coupling member and is adapted to pivot the coupling member with respect to the vehicle.

The present invention further advantageously provides an assembly for an underwater vehicle that includes a motor, a duct having a generally cylindrical shape oriented about a longitudinal axis, and a propeller having an axis of rotation. The propeller is mounted within the duct and is driven by the motor. The propeller and the duct are connected such that the axis of rotation of the propeller and the longitudinal axis of the duct have a fixed orientation with respect to one another. The assembly further advantageously includes a means for changing an orientation of the axis of rotation of the propeller and the longitudinal axis of the duct with respect to the vehicle.

BRIEF DESCRIPTION OF THE DRAWINGS

A more complete appreciation of the invention and many of the attendant advantages thereof will become readily apparent with reference to the following detailed description, particularly when considered in conjunction with the accompanying drawings, in which:

FIG. 8(*b*) is a side view of the coupling member depicted in FIG. 8(*a*);

FIG. 8(*c*) is a cross-sectional, side view of the coupling member depicted in FIG. 8(*a*) taken along line VIII(c)—VIII(c);

DETAILED DESCRIPTION OF THE INVENTION

The present invention provides an assembly having an articulated, ducted thruster for improved underwater vehicle control and propulsion. Generally speaking, the invention utilizes a ducted ring positioned around a perimeter of a propeller, where the ducted ring and the propeller move in unison to provide an efficient and easily maneuverable underwater vehicle. This configuration is in contrast to a propulsion system where the propeller has a fixed directional orientation with respect to the underwater vehicle. The configuration of the present invention advantageously provides a propulsion system having characteristics of low power consumption, high stability, and accurate control and maneuverability. The invention provides high stability with less deflection of the control surfaces within a smaller exterior diameter for various submarine-like underwater vehicles.

The articulated tailcone or tail assembly of the present invention is particularly well suited for use as the propulsion and control system of a special class of underwater vehicles commonly referred to as Autonomous Underwater Vehicles (AUVs). The tail assembly is preferably situated at the aft end of the vehicle. The tail assembly provides for the efficient transfer of power into thrust, while the controlled orientation of the tail assembly creates the desired directional forces in a prescribed manner and in ample proportion to create coordinated motions in a submerged environment. The present invention is well suited to perform long term, large area, data acquisition of water column characteristics.

Figure 1:
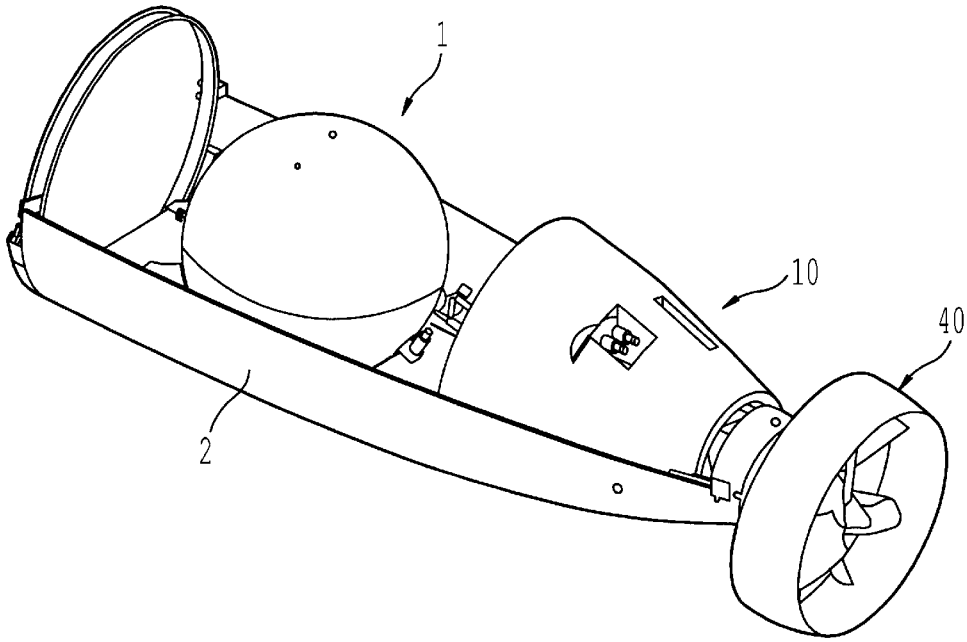
FIG. 1 is a perspective view of an assembly according to an embodiment of the present invention depicted within an aft portion of an underwater vehicle with a top shell of the vehicle removed.
Figure 2:
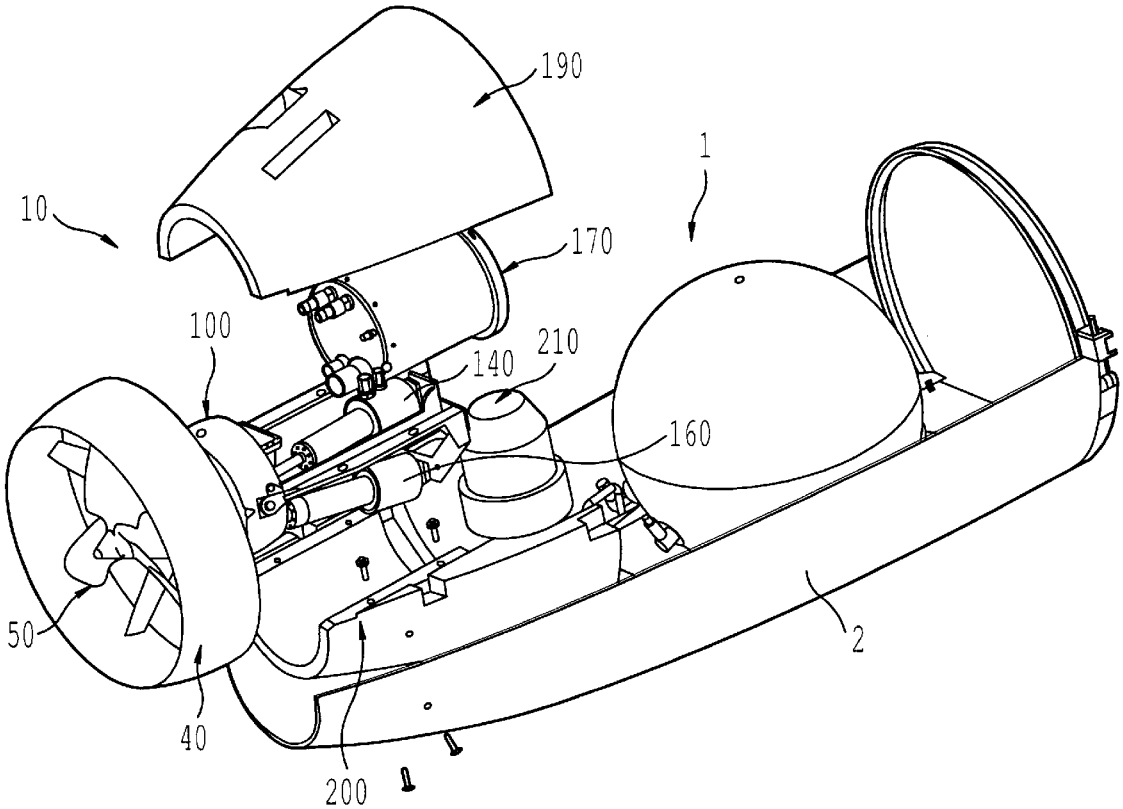
FIG. 2 is a partially exploded, perspective view of the assembly depicted in FIG. 1.

FIGS. 1–18 depict a preferred embodiment of the present invention. FIGS. 1 and 2 depict an embodiment of a tail assembly 10 of the present invention within an aft portion of an underwater vehicle 1 with a top shell of a vehicle body removed and a bottom shell 2 of the vehicle body depicted. The tail assembly 10 of the present invention can be incorporated within the aft portion of the vehicle body either in a retrofit manner or in an original manufactured configuration.

Figure 3:
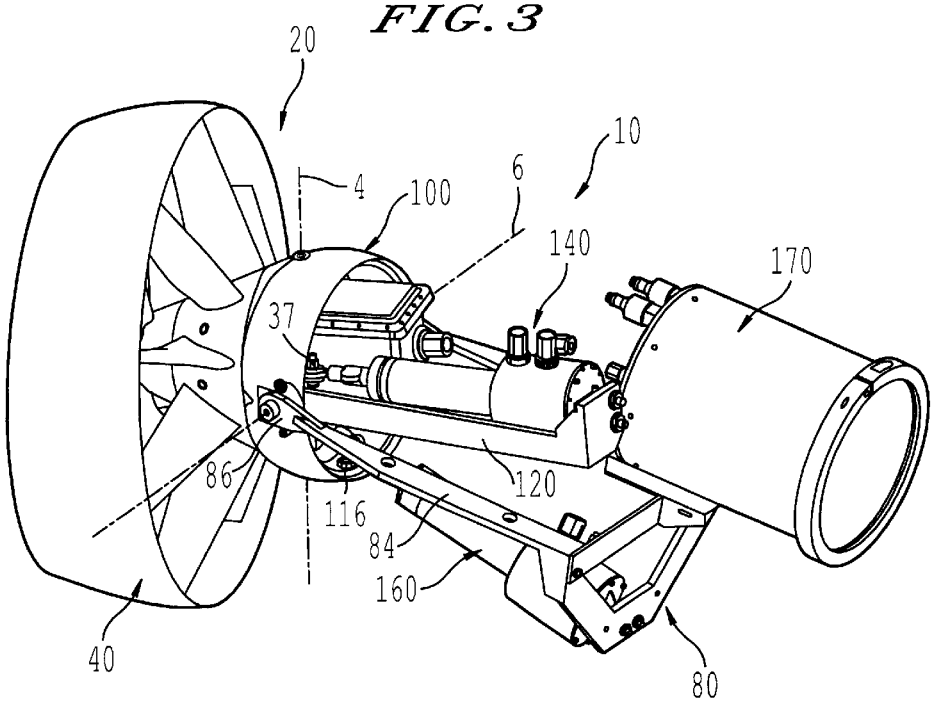
FIG. 3 is a perspective view of the assembly according to an embodiment of the present invention.
Figure 4:
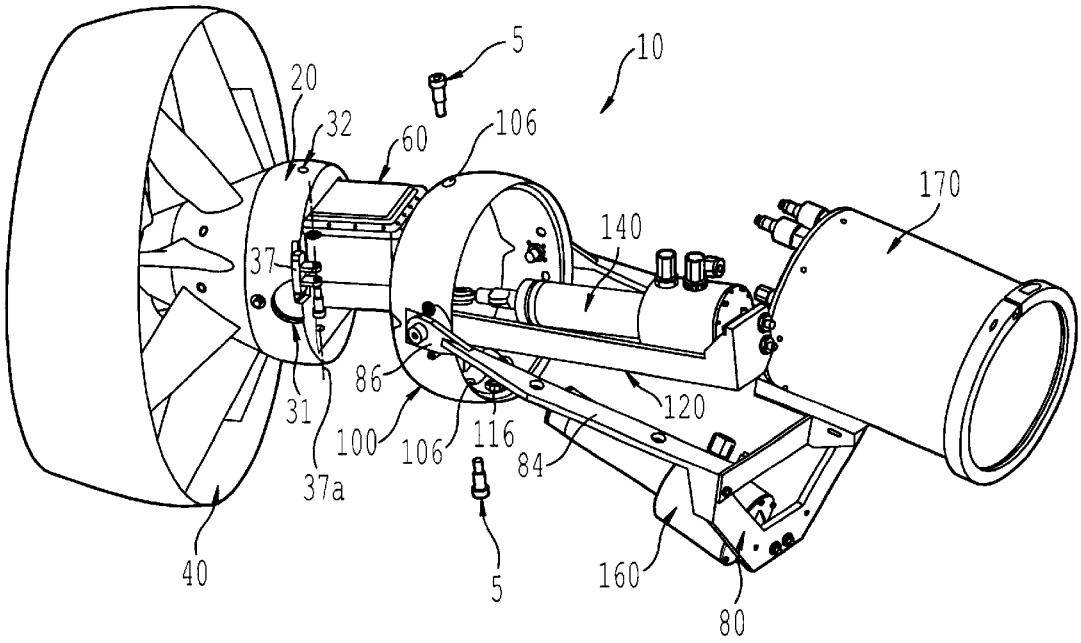
FIG. 4 is a partially exploded, perspective view of the assembly depicted in FIG. 3.

As depicted in FIGS. 3 and 4, the present invention advantageously provides a tail assembly 10 for an underwater vehicle that includes a duct assembly 20, a motor 60, and a first actuator 140. The duct assembly 20 generally includes a duct 40 and a propeller 50 mounted within the duct 40, where the propeller 50 is driven by the motor 60. The first actuator 140 is connected to the duct assembly 20 and is connected to the vehicle 1, as will be described in more detail below. The first actuator 140 advantageously pivots the duct assembly 20 with respect to the vehicle 1. Preferably, the tail assembly 10 further includes a coupling member 100 mounted to the vehicle 1 and configured to pivotally receive a portion of the duct assembly 20, where the duct assembly 20 is configured to pivot within the coupling member 100. Additionally, the tail assembly preferably includes a second actuator 160 mounted to the vehicle 1, where the second actuator 160 is connected to the coupling member 100 and is adapted to pivot the coupling member 100 with respect to the vehicle 1.

Figure 5:
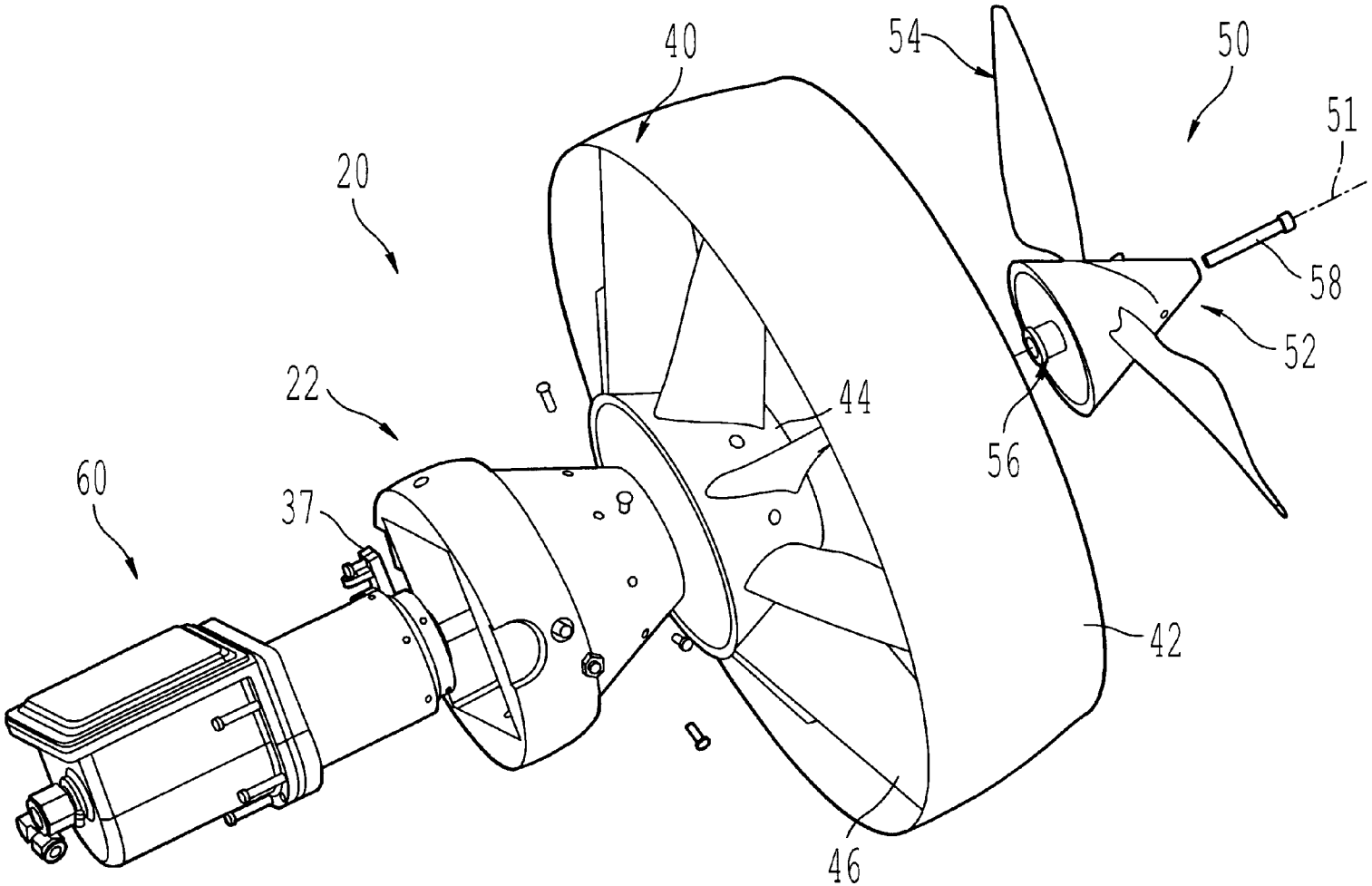
FIG. 5 is a partially exploded, perspective view of a duct assembly according an embodiment of the present invention.

Generally speaking, the tail assembly of the present invention can alternatively be described as providing a motor 60, a duct 40 having a generally cylindrical shape oriented about a longitudinal axis 41 (see FIG. 7), and a propeller 50 having an axis of rotation 51 (see FIG. 5). The propeller 50 is mounted within the duct 40 and is driven by the motor 60. The propeller 50 and the duct 40 are connected such that the axis of rotation 51 of the propeller 50 and the longitudinal axis 41 of the duct 40 have a fixed orientation with respect to one another. The tail assembly 10 further advantageously includes a means or system for changing an orientation of the axis of rotation 51 of the propeller 50 and the longitudinal axis 41 of the duct 40 with respect to the vehicle 1.

Figure 7:
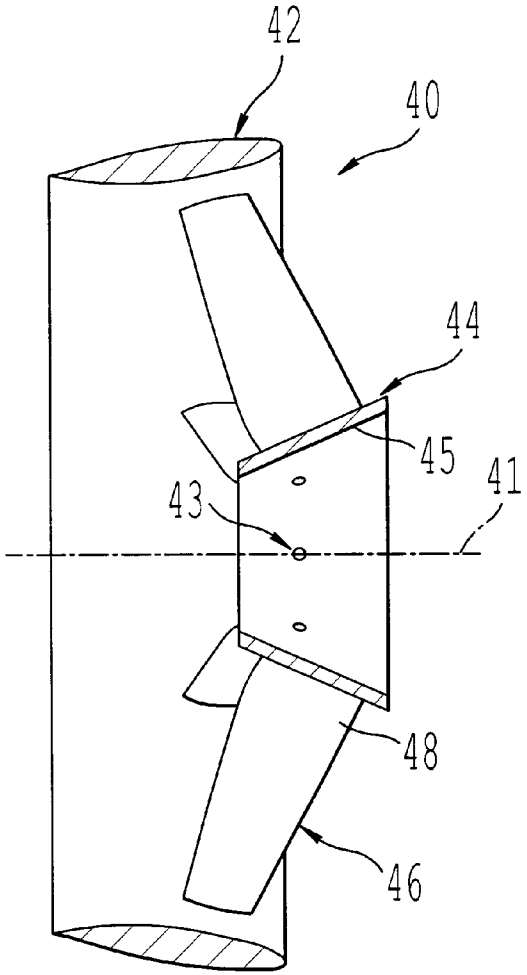
FIG. 7 is a cross-sectional, side view of a duct according to an embodiment of the present invention.
Figure 6:
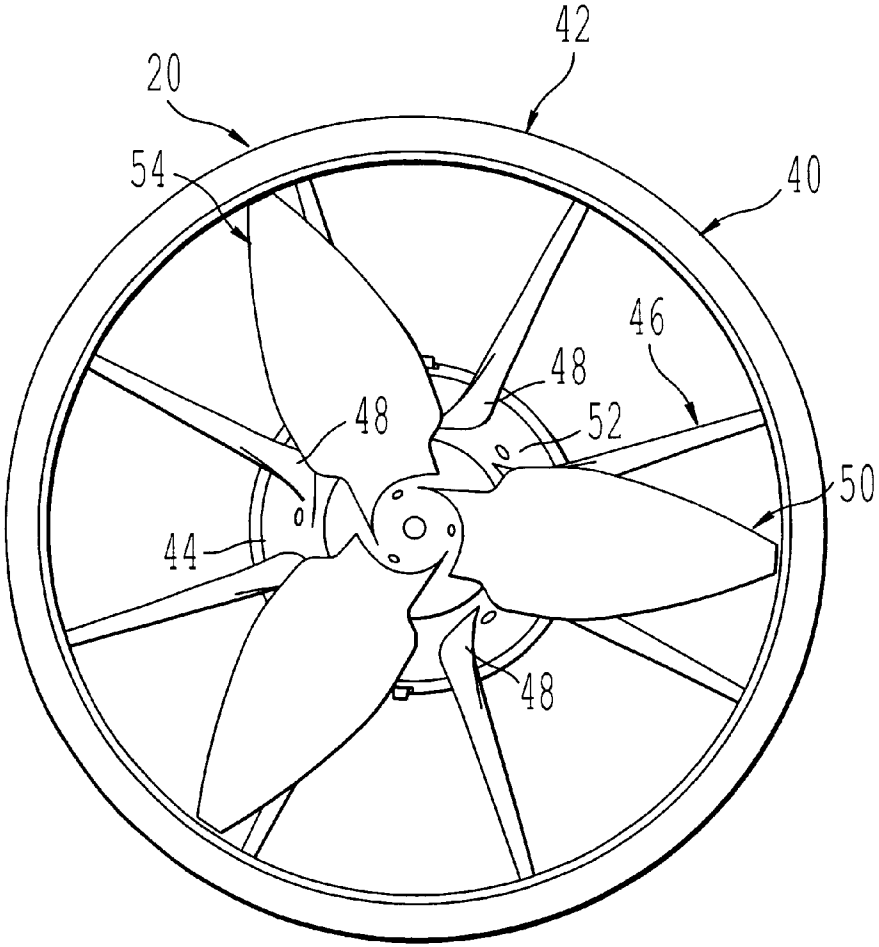
FIG. 6 is an assembled, rear view of the duct assembly depicted in FIG. 5.

FIGS. 5 and 6 depict the duct assembly 20, and FIG. 7 depicts a cross-sectional view of the duct 40. The configuration of the integrated duct 40 and propeller screw 50 was chosen in order to increase the efficiency of the vehicle 1. A ductless propeller does not have the capability of benefiting from the vectored water mass at the tip of each blade. While a ducted propeller will gain a five to ten percent increase in efficiency by reducing the loss of lift (thrust) occurring at each blade tip. The use of a duct with the propeller also provides substantially more control surface area for maneuvering.

An additional genesis of the duct concept was the benefit that the propeller and the control surfaces will be protected from damage occurring from natural and operational sources. The duct substantially protects the propeller from entanglement with lines, seaweed, and other hazards. The inherent strength of a ducted ring will minimize the potential damage that can occur during launch and recovery in high sea states.

The duct 40 includes an outer duct ring 42, an inner shaft 44, and a plurality of fins 46 connecting the outer duct ring 42 to the inner shaft 44. The outer duct ring 42 extends about a perimeter of the propeller 50. The outer duct ring 42 is generally tubular in shape and preferably has a hydrodynamically efficient cross-sectional shape. The circumferential ring 42 is hydro-dynamically shaped to optimize lift at numerous angles of attack. The fins 46 have a skewed surface 48 adjacent the inner shaft 44 which acts as a means for counteracting torque resulting from forces produced by the propeller 50 on a fluid flowing therethrough. In other words, the base of each duct fin 46 is provided with a skewed surface 48 to counteract the torque resulting from the forces of the propeller 50 on the water mass, thereby providing a passive resistance feature to assist in mitigating the need for a more complex contra-rotation system or the addition of torque resisting appendages that are more prone to damage.

The inner shaft 44 of the duct 40 preferably has a hollow, truncated conical shape. The inner shaft 44 includes an inner surface 45 that is configured to receive an second section 34 of the coupling body 22. The inner shaft 44 has several holes 43 extending therethrough that are configured to receive fastening members used to rigidly join the duct 40 to the coupling body 22.

The propeller 50 includes a base or nose portion 52 that is preferably conical in shape. The base portion 52 has a plurality of blades 54 extending radially outward therefrom, which are configured to transform the torque of the motor 60 into thrust by acting against the fluid within which the vehicle 1 is travelling. The base portion 52 has receiving hole 56 extending therethrough along the rotational axis 51 of the propeller 50. The output shaft 70 of the motor 60 extends within the hole 56 and is coupled to the base portion 52 by a fastener 58, thereby ensuring that the rotation of output shaft 70 of the motor 60 is transferred to the base portion 52 of the propeller 50.

Figure 8A:
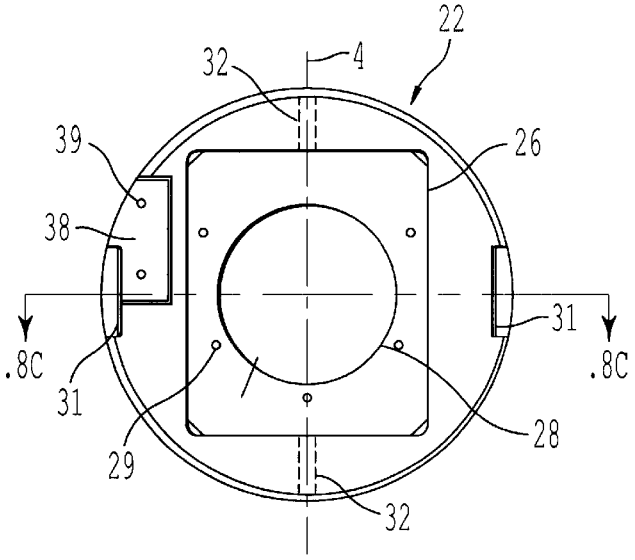
FIG. 8(*a*) is a front view of a coupling member according to an embodiment of the present invention.
Figure 8B:
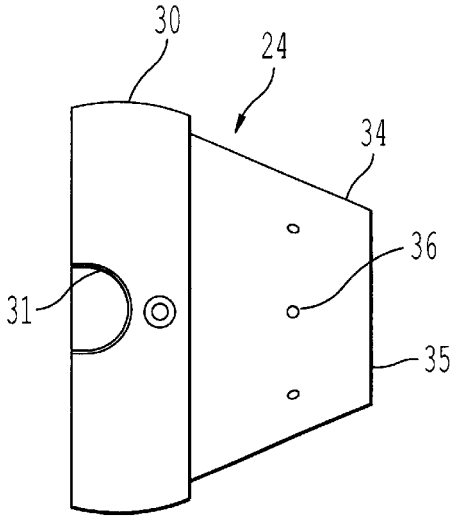
Figure 8C:
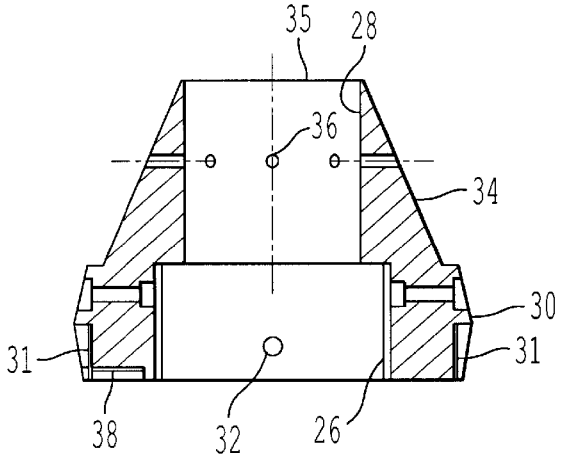

The duct assembly 20 further includes a coupling body 22, which is depicted in FIGS. 5 and 8(*a*)–8(*c*). The coupling body 22 has an outer surface 24 preferably having a generally truncated, conical shape. The coupling body 22 has a hollow interior portion 26 configured to receive the motor 60. The motor 60 has front portion 63 and a drive shaft 70 extending from the interior portion 26 through an aperture 28 in an end portion of the coupling body 22. The coupling body 22 has an outer surface 24 with a first section 30 that defines the portion of the duct assembly 20 received by the coupling member 100 and a second section 34 configured to receive the duct 40. The second section 34 abuts the inner surface 45 of the inner shaft 44 of the duct 40. The holes 43 on the inner shaft 44 align with holes 36 on the second section 34 of the coupling body 24, whereby fastening members can extend within holes 43 and holes 36 to join the duct 40 to the coupling body 22. The coupling body 22 includes an end surface 35 that is positioned proximate the base portion 52 of the propeller 50, however, note that the propeller 50 rotates about the rotational axis 51 while the coupling body 22 does not rotate about the rotational axis 51.

The coupling member 100 is joined to the coupling body 22 of the duct assembly 20 by pins 5 such that the duct assembly 20 is pivotable about a first axis 4 (see FIG. 3). The pins 5 define the first axis 4 and extend through holes 32 on the coupling body 22 and holes 106 on the coupling member 100. The first section 30 includes recessed portions 31 that are provided in order to avoid contact between the coupling body 22 and fasteners used to join a support arm 120 and the coupling member 100. The coupling body 22 includes a seat portion 39 and fastening holes 39 used to receive a bracket 37 used to couple the coupling body 22 and the first actuator 140.

The present invention includes a motor 60 that is used to drive the propeller 50. The term motor is being used in a very broad sense, and can include any type of internal combustion motor, any type of electric motor, or any other type of drive means. The present invention preferably advantageously mounts the motor 60 within the duct assembly 20, more specifically within the coupling body 22, in order to allow the motor to efficiently and rigidly couple to the propeller, thereby allowing the duct assembly 20 and the propeller 50 to jointly pivot with respect to the vehicle 1.

Figure 9:
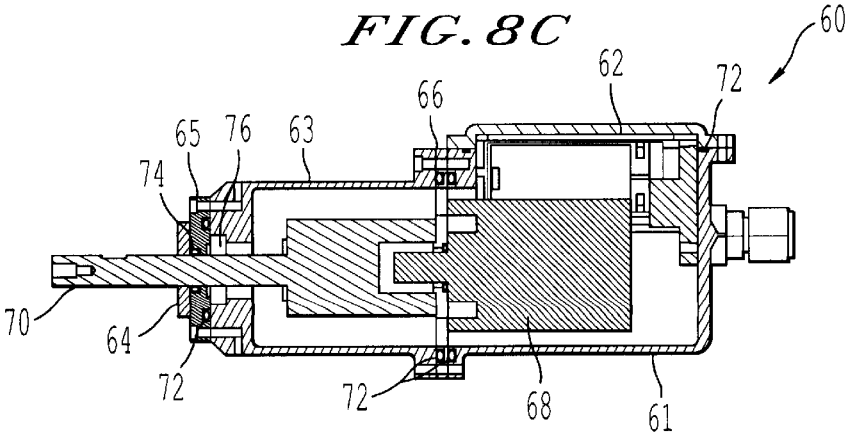
FIG. 9 is a cross-sectional, schematic view of an embodiment of a motor according to the present invention.

The propulsion motor 60 utilized for the embodiment described herein and depicted in FIG. 9 is an Aveox 2315 brushless DC motor controlled by an Aveox H-160 motor controller, and a Pontech SV203 RS-485 to Pulse Width Modulation interface. Brushless motors have several benefits over motors that have brushes. For example, brushless motors are more efficient due to the elimination of brush drag. Additionally, brushless motors are less noisy, require no maintenance, and have no deterioration in performance. The motor 60 of the present invention is running in oil, and therefore the issue of carbon build-up resulting in dirty brushes is eliminated. The Aveox 2315 motor has a maximum power rating of 3500 W and is capable of a maximum speed of 10,000 RPMs at sixty-five percent efficiency. Since the motor of the present invention is preferably used at 3,000 W to 4,000 W, a much higher efficiency is attainable for the present invention.

The H-160 controller controls power and rotational direction of the motor. The H-160 is a 5V–40V Hall Effect sensor commutated and has a three-phase configuration. Using an optically isolated low frequency signal, rotational direction and power level can be controlled using a Pulse Wave modulated (PWM) format. A PWM of 1.5 mS means no motor power, while a PMW of less than 1.5 mS means forward power and a PWM of greater than 1.5 mS means that the motor is reversed. The Pontech SV203 interface device is used to generate the low frequency PWM waveform that controls the Aveox H-160.

The embodiment of the present invention described herein includes a gearbox 63 that is a CGI 017PLX0100 planetary gearhead. The gearbox is configured for a 10:1 gear ratio allowing an operational propeller speed of 300 RPMs to 400 RPMs. The gearbox has a weight of only one pound and is capable of providing 130 in-lbs. of continuous torque with a shaft output of nearly 500 RPMs. This rate provides an efficiency of over ninety percent. An acceptable standard backlash of 6 arc/minute will be experienced. The units are fabricated with a multi-section stainless steel and aluminum housing. Case hardened steel planetary, ring, and pinion gears will run in Shell Tellus 22 lubrication/compensating oil. The output shaft 70 is made of 17-4 stainless steel with 54Rc hardness for spring seal and seawater compatibility. The shaft has been modified to incorporate three flat, one hundred and twenty degrees apart. These flats are used in conjunction with three setscrews extending through holes in the base portion 52 of the propeller 50 and secure the propeller for torque transfer. A threaded hole on the end of the shaft is used with a shoulder screw as an extra measure of securing the propeller using fastener 58. The gearhead connects to the motor output shaft through a pinion shaft collet using a rotationally balanced clamp. The gearhead and the motor attach to an interface plate 66 that is a structurally integrated component of the gearbox 63 and motor housing 61. The interface plate 66 permits the motor thruster 68 and gearbox 63 torque to be transferred directly into the coupling body 22 via fasteners extending through holes in the interface plate 66 and into holes 29 within the hollow interior portion 26 of the coupling body 22. The motor housing 61 has a cover 62 and the end of the gearbox 63 has an open ball bearing 76, a bearing retainer plate 65 having a seal 74, and a seal retainer plate 64. The motor 60 includes various o-ring sealing members 72.

Figure 10:
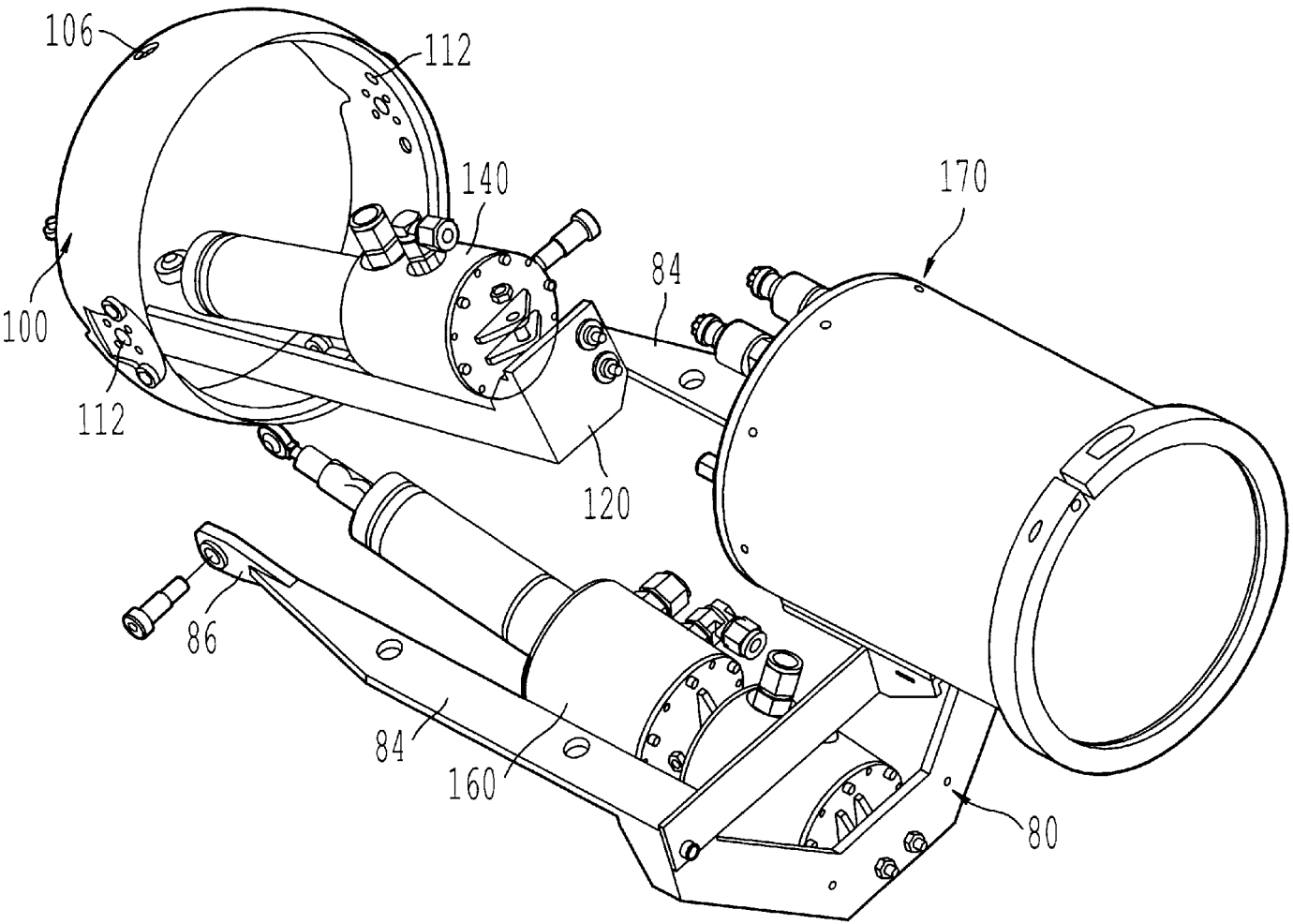
FIG. 10 is a partially exploded, front, perspective view of various components of an embodiment of the present invention, which mount and control the orientation of the duct assembly with respect to the vehicle.
Figure 11:
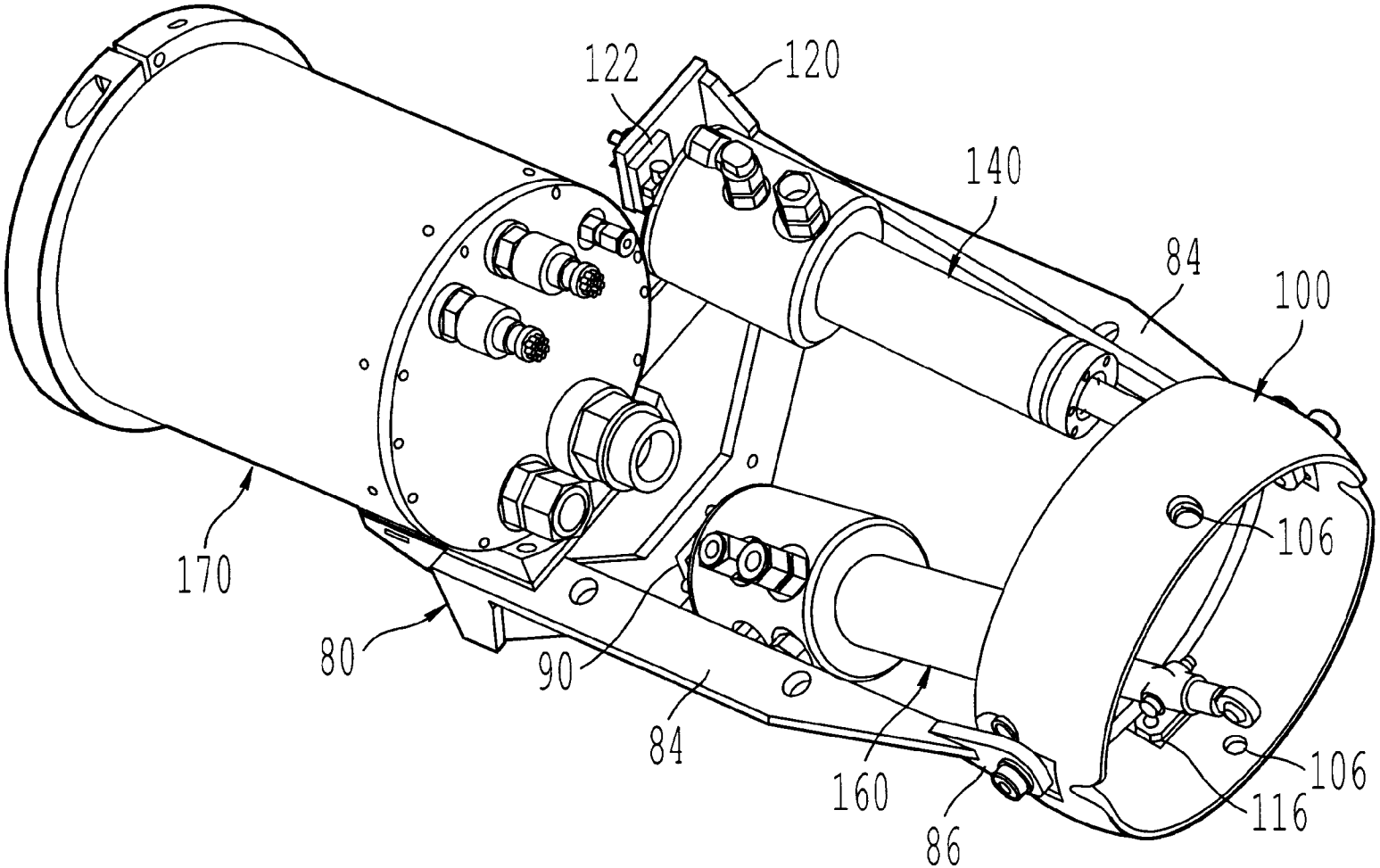
FIG. 11 is a rear, perspective view of the various components depicted in FIG. 10.
Figure 12:
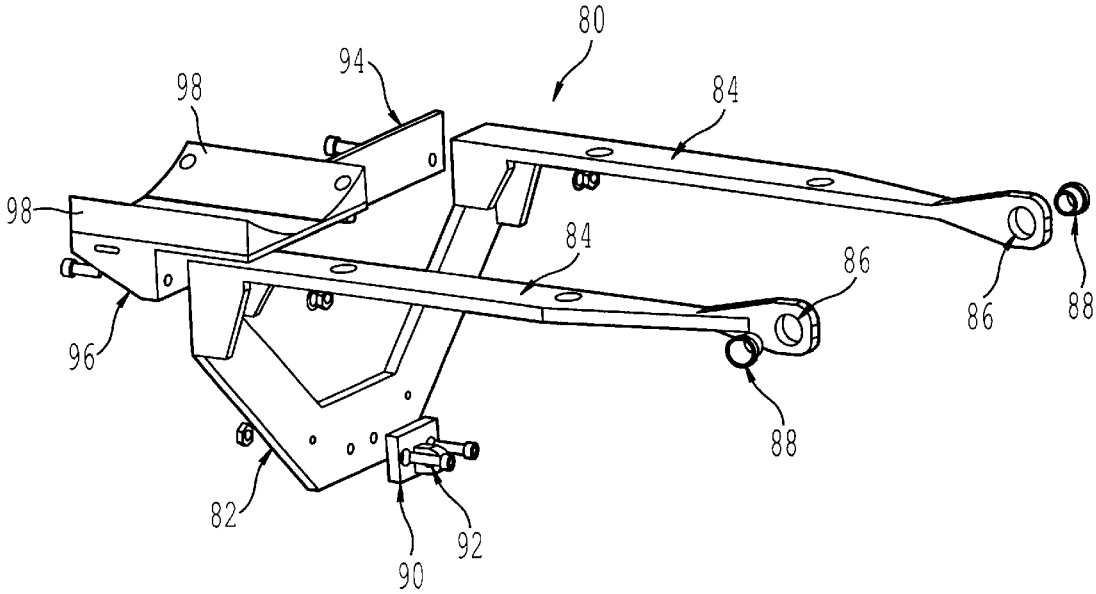
FIG. 12 is a perspective view of a mounting assembly according to an embodiment of the present invention.
Figure 13:
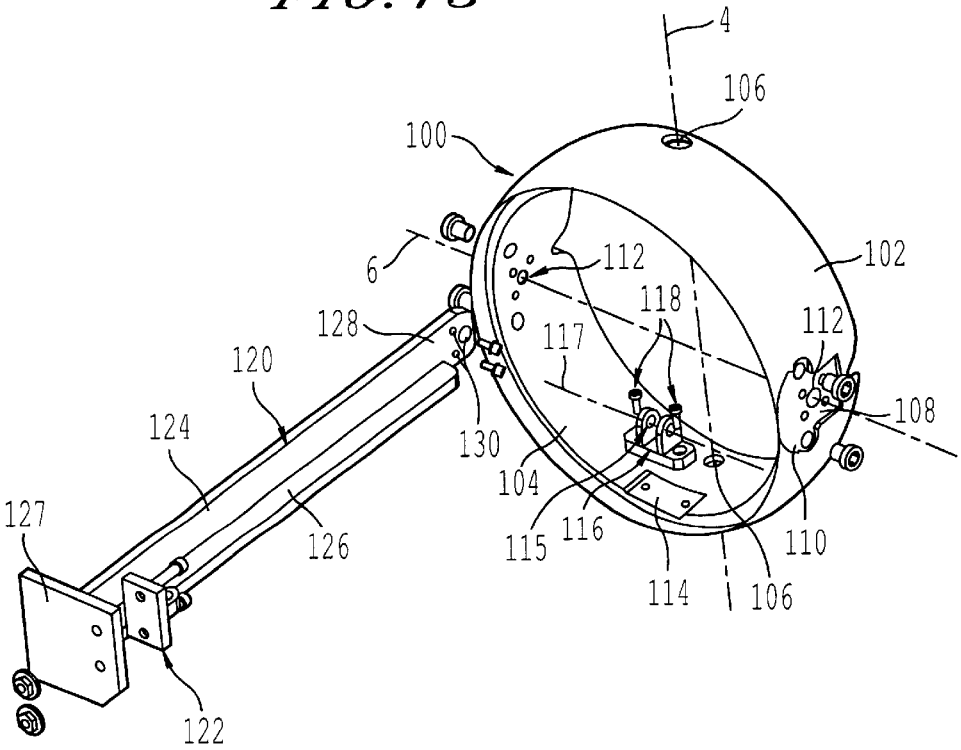
FIG. 13 is a partially exploded, perspective view of a coupling member and support arm according to an embodiment of the present invention.

The present invention includes a system that is configured to adjust the orientation of the duct assembly 20 with respect to the vehicle 1 in order to steer the vehicle 1 within an underwater environment. FIGS. 10 and 11 depict various components of an embodiment of the present invention, which mount and control the orientation of the duct assembly with respect to the vehicle. FIGS. 12 and 13 depict various structural components that facilitate the motion of the duct assembly 20, as well as provide for the mounting of the duct assembly 20 to the vehicle 1.

FIGS. 10 and 11 depict a mounting assembly 80, a coupling member 100, a support arm 120, a first actuator 140, a second actuator 160, and a controller 170. The mounting assembly 80 is rigidly mounted to the vehicle 1 via a bottom member 200, which is mounted to the vehicle body. The mounting assembly 80 supports the various components depicted in FIGS. 10 and 11, as well as the duct assembly 20, propeller 50, and motor 60. The controller 170 is mounted to an upper portion of the mounting assembly 80. The coupling member 100 is pivotally mounted to terminal ends 86 of arms 84 of the mounting assembly such that the coupling member 100 can pivot about axis 6 (depicted in FIG. 3). The coupling member 100 is actuated to pivot about axis 6 by a second actuator 160 that is pivotally connected to a bracket 90 on the mounting assembly 80 and to a bracket 116 on the coupling member 100. The support arm 120 is rigidly mounted to the coupling member 100. The duct assembly 20 is pivotally connected to holes 106 in the coupling member 100 such that the duct assembly 20 can pivotal about axis 4 (depicted in FIG. 3). The duct assembly 20 is actuated to pivot about axis 4 by a first actuator 140 that is pivotally connected to a bracket 122 on the support arm 120 and to a bracket 37 (see FIG. 4) on the coupling body 22.

FIG. 12 depicts a mounting assembly 80 that includes a bracket 82 that is rigidly mounted to the vehicle 1 via a bottom insulation member 200 that is mounted to the vehicle body. The bracket 82 having a pair of arms 84 with terminal ends 86 having holes therethrough with bearings 88 therein. The terminal ends 86 are pivotally joined to the coupling member 100 about an axis 6 depicted in FIG. 13 extending through holes 112 of the coupling member 100. The mounting assembly 80 further includes a bracket 90 having a mounting hole 92 that is used to pivotally mount an end of the second actuator 160. The mounting assembly 80 includes a support 94 that extends between ends of the arms 84. The support 94 includes a base portion 96 that is used to support wedge-shaped elements 98. The wedge-shaped elements 98 receive the controller 170, which is fixedly mounted thereon.

FIG. 13 depicts the coupling member 100 and a support arm 120. The coupling member 100 is generally ring-shaped with an outer surface 102 and an inner surface 104. The inner surface 104 preferably has a semi-spherical contour and is configured to receive the first section 30 of the coupling body 22. Additionally, the outer surface of the first section 30 of the coupling body 22 also preferably has a semi-spherical contour. The coupling member 100 includes holes 106 that are configured to receive pins 5 (depicted in FIG. 4), which pivotally couple the coupling member 100 and the coupling body 22 about axis 4. The pivotal coupling about axis 4 provides the duct assembly 20 with the ability to pivot about a vertical axis using the first actuator 140, thereby providing yaw control of the vehicle 1.

The outer surface 102 of the coupling member 100 includes a seat portion 108 that receives the ends of the arms 84 such that a fastening device extends through hole 86 of the ends of the arms 84 and through holes 112 in the coupling member 100, whereby the coupling member 100 is pivotally coupled to the mounting assembly 80 about axis 6. The pivotal coupling about axis 6 provides the coupling member 100, and the duct assembly 20 that is mounted to the coupling member 100, with the ability to pivot about a horizontal axis using the second actuator 160, thereby providing pitch control of the vehicle 1. Note that the seat portion 108 includes a recessed portion 110 that allows the coupling member 100 to pivot without interference with the ends of the arms 84 of the mounting assembly 80.

The inner surface 104 of the coupling member 100 includes a seat portion 114 that receives a bracket 116 having holes 115 used to pivotally connect an end of the second actuator 160 to the coupling 100 about an axis 117. The second actuator 160 is pivotally joined to the coupling member 100 about axis 117, such that the axis 6 is parallel to and offset from the axis 117. The bracket 116 is mounted to the coupling member using fasteners 118.

The support arm 120 includes an elongated body 124 having an elongated support member 126 that provides rigidity to the support arm 120. The support arm 120 has a base end 127 having a bracket 122 mounted thereto. The bracket 122 pivotally mounts an end of the first actuator 140 to the support arm 120. The support arm 120 has an end 128 having a plurality of holes 130. The end 128 of the support arm 120 is rigidly mounted to the inner surface 104 of the coupling member 100 using a plurality of fasteners extending through the plurality of holes 130 and into the coupling member 100.

Figure 14:
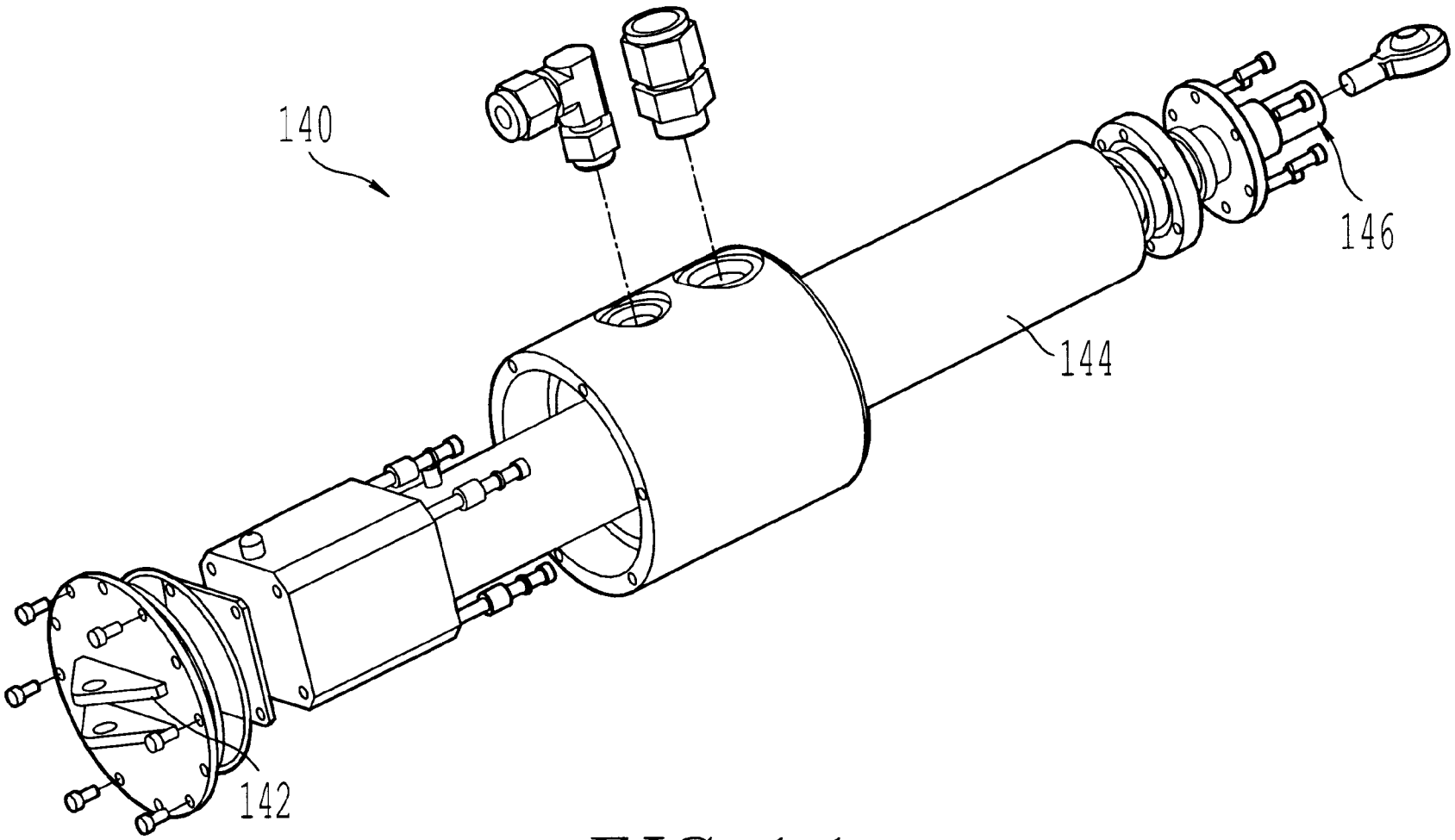
FIG. 14 is a partially exploded, perspective view of an actuator according to an embodiment of the present invention.

FIG. 14 depicts an exploded view of the first actuator 140. The second actuator 160 is identical in structure to the first actuator 140. The first actuator 140 includes a bracket 142 at a base end thereof. The bracket 142 is configured to pivotally connect to the bracket 122 of the support arm 120. The first actuator 140 includes an elongated body 144 having a movable piston or telescopic arm 146 slidably provided within the elongated body 144. The first actuator is configured to actuate the linear position of the telescopic arm 146 with respect to the elongated body. An end portion of the telescopic arm 146 is pivotally connected to the bracket 37 (see FIG. 4) on the coupling body 22, whereby the duct assembly 20 is actuated to pivot about axis 4 by a first actuator 140. The first actuator 140 is pivotally joined to the coupling body 22 by bracket 37 about axis 37*a*, such that the axis 4 is parallel to and offset from the axis 37*a*.

In the preferred embodiment, the two linear actuators 140 and 160 are manufactured by Ultra Motion and are used to control the duct that steers the vehicle. A parallel driven stepper motor coupled with a 0.083 pitch ACME lead screw drives the actuators. The configuration of the linear actuators 140 and 160 results in a two inch linear stroke. Each actuator is housed in an oil-filled pressure compensated case. A dual cup spring driven seal is used to resist seawater intrusion at the stainless steel shaft. Each of the actuators is responsible for one direction of vehicle control. The first actuator 140 is responsible for providing movement of the duct in a vertical component (pitch), while the second actuator 160 provides movement in a horizontal component (yaw). The actuators are capable of working simultaneously to provide ±15 degrees of duct movement, such that the duct assembly 20 is configured to pivot about axis 4 by at least ±15 degrees from center, and such that the coupling member 100 is configured to pivot about axis 6 by at least ±15 degrees from center. This equates to a controlled turn of nearly ten degrees per second. The first and second actuators are preferably configured to provide at least 5 Nm of torque in order to provide sufficient power to steer the vehicle, and are preferably configured to have an accuracy of at least 0.5 degrees. Alternatively, other types of actuators can be utilized in the present invention, for example, non-linear actuators or linear actuators that are actuated using hydraulics, pneumatics, or some other means.

Figure 15:
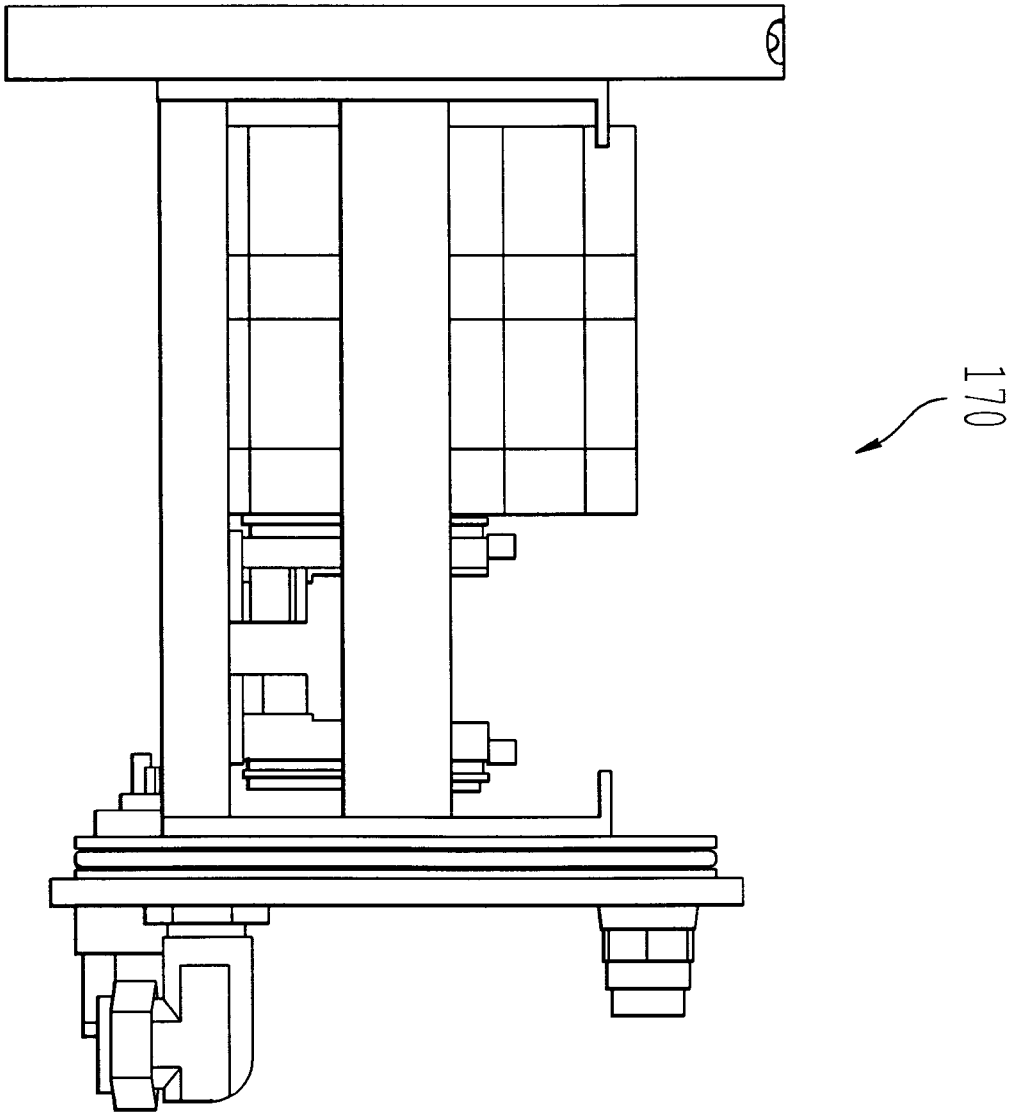
FIG. 15 is a side view of a controller according to an embodiment of the present invention, where the controller is depicted with an outer housing removed.

In the preferred embodiment, the controller 170 is a microcontroller as depicted in FIG. 15 with the outer housing removed. The microcontroller preferably uses an Instrument Bus Computer format. The controller acts as a control device adapted to be mounted within the vehicle and configured to control movement of the first actuator 140, the second actuator 160, and the motor 60.

Figure 16:
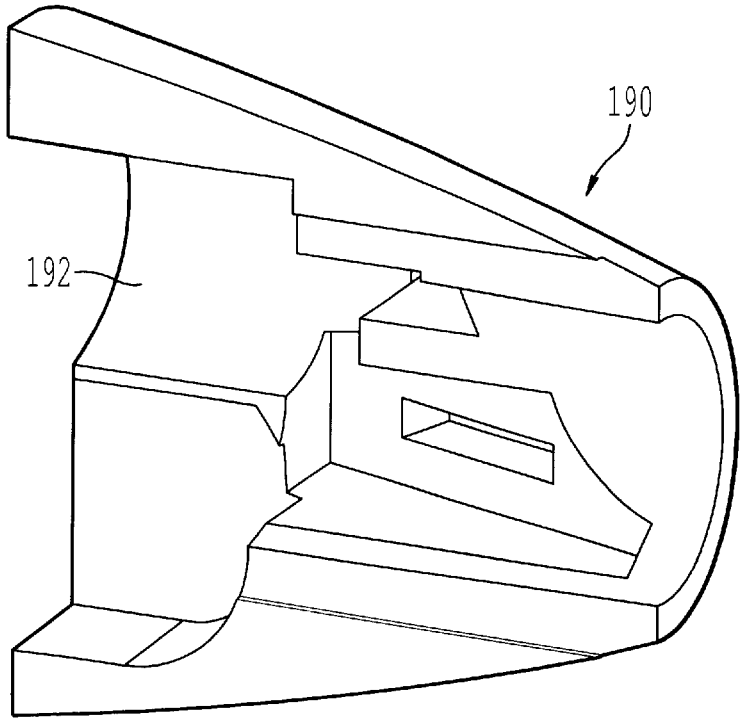
FIG. 16 is a perspective view of a top insulation member according to an embodiment of the present invention.
Figure 17:
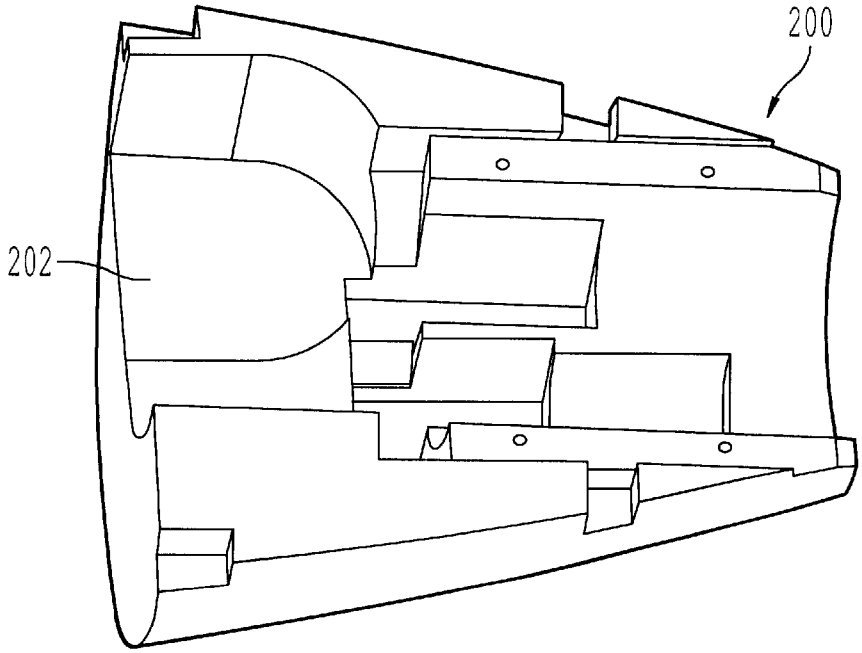
FIG. 17 is a perspective view of a bottom insulation member according to an embodiment of the present invention.

FIG. 16 depicts a top insulation member 190 according to an embodiment of the present invention, and FIG. 17 depicts a bottom insulation member 200 according to an embodiment of the present invention. The top insulating member 190 and the bottom insulating member 200 provide a thermal and acoustic housing for the various components of the invention provided with in the vehicle body, as depicted in FIGS. 1 and 2. The top and bottom insulating members are mounted within the tail or aft portion of the vehicle. The mounting assembly 80 is rigidly mounted to the bottom insulating member 200, thereby fixing the mounting assembly 80, and the components mounted thereto, to the vehicle 1. The top insulating member 190 has a recessed portion that is formed to receive the various components of the invention, and provide sufficient space to allow the components to move freely therein during movement of the first actuator 140 and the second actuator 160, and the movable components attached thereto.

Figure 18:
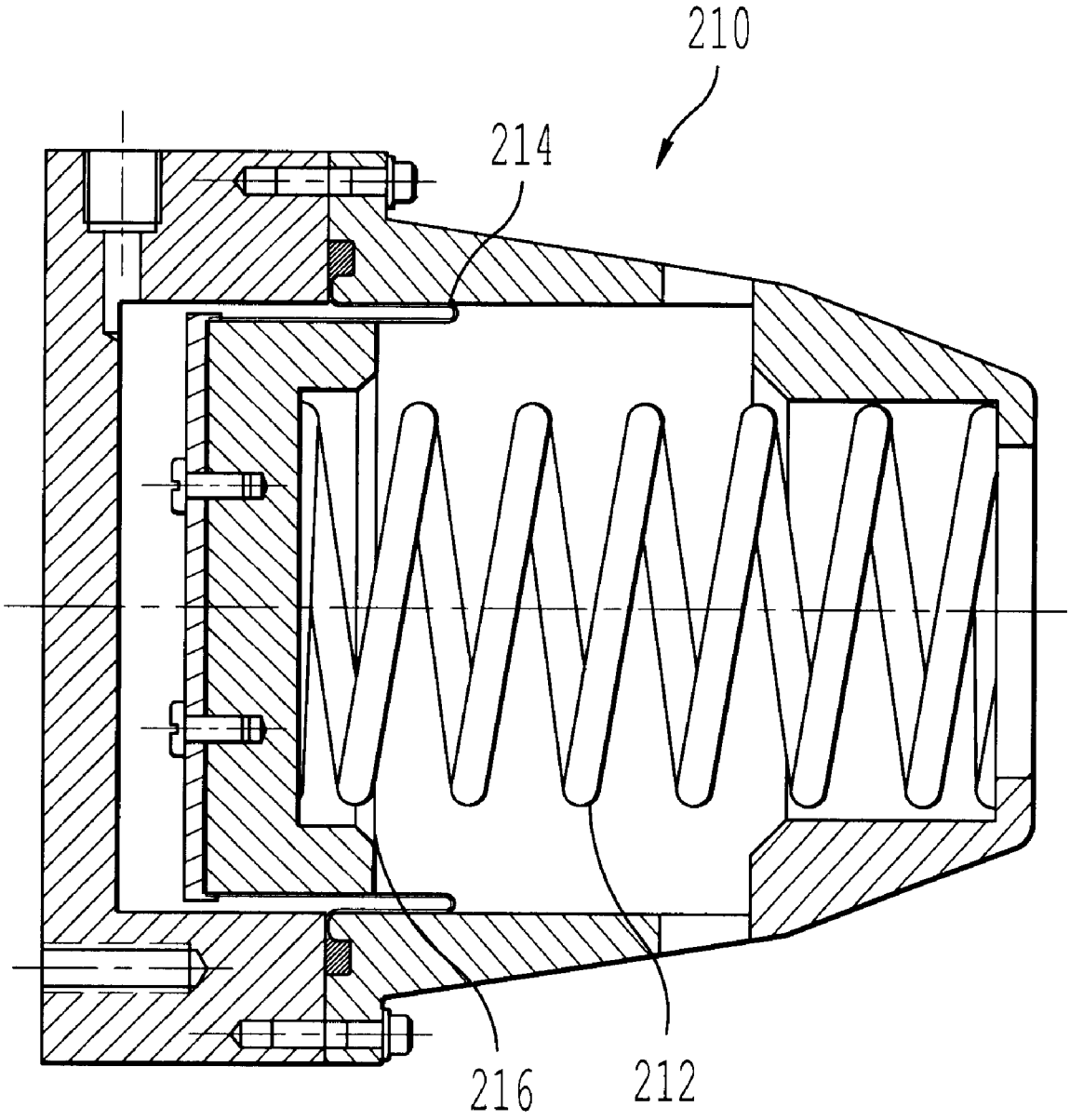
FIG. 18 is a cross-sectional side view of a pressure compensator according to embodiment of the present invention.

FIG. 18 depicts a pressure compensator 210 according to a preferred embodiment of the present invention. The pressure compensator 210 is used to provide pressurized oil to the housing of the invention and the various wiring tubes. The pressure compensator 210 includes a spring 212, a spring-actuated rolling diaphragm 214, and a piston 216 that provides up to twenty-five cubic inches of 3 PSI to 5 PSI pressure to each of the oil filled housings (for example, in the motor 60, the first actuator 140, the second actuator 160, and the controller 170) and wire tubes. The minimal pressure is used as a visual indicator of system integrity while the vehicle is on a deck of a launching vessel prior to and after launch of the vehicle. The oil pressure also acts to mitigate water intrusion from small leaks while the vehicle is submerged. The oil used is Shell Tellus 22, a light lubricating oil. This oil is used due to its material compatibility, non-conductivity, lower viscosity, and temperature range. The oil also provides some lubricity to the bearing and gears in the motor 60.

The various interconnections between the components of the invention have been omitted from the figures in order to ensure that the components of the invention are clearly depicted. One of ordinary skill in the art in light of the detailed description of the invention provided herein will readily comprehend the interconnections described herein. For example, the necessary interconnections between the controller 170 and the first actuator 140, the controller 170 and the second actuator 160, and the controller 170 and the motor 60 will be readily apparent to one of ordinary skill in the art. The fittings for the various interconnections are depicted in the figures.

In the preferred embodiment, the tail assembly 10 of the present invention is configured with the following characteristics; a minimum of ±15 degree range of motion for the duct assembly; an actuator torque of at least 5 Nm; an actuator accuracy of at least 0.5 degrees; a robust configuration capable of high impact resistance during launch and recovery of the vehicle; and the tail assembly is field serviceable. Such features are configured into the preferred embodiment described above.

The tail assembly 10 of the present invention is particularly well suited for use in an autonomous underwater vehicle, although the tail assembly 10 can alternatively be utilized in tethered vehicle configurations. The tail assembly 10 of the present invention is also particularly well suited for use in unmanned vehicles, however the tail assembly 10 can alternatively be utilized in manned vehicle configurations. Furthermore, the preferred embodiment of the present invention is described as being configured in the tail or aft portion of the vehicle, however the invention can be configured in other portions of the vehicle, for example, on wing or fin-like structures.

It should be noted that the exemplary embodiments depicted and described herein set forth the preferred embodiments of the present invention, and are not meant to limit the scope of the claims hereto in any way.

Numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. An assembly for an underwater vehicle, said assembly comprising:

a motor;

a duct assembly including a duct and a propeller mounted within said duct, said propeller being configured to be driven by said motor;

a first actuator adapted to be connected to the vehicle, said first actuator being connected to said duct assembly and adapted to pivot said duct assembly with respect to the vehicle; and a coupling member adapted to be mounted to the vehicle and configured to pivotally receive a portion of said duct assembly, wherein said coupling member is joined to said portion of said duct assembly by at least one pin such that said duct assembly is pivotable about a first axis, and wherein said coupling member is adapted to be mounted to the vehicle by at least one pin such that said coupling member is pivotable about a second axis, said second axis being perpendicular to said first axis.

2. The assembly according to claim 1, wherein said first actuator is adapted to be connected to the vehicle via a member rigidly mounted to said coupling member.

3. The assembly according to claim 1, further comprising:

a second actuator adapted to be mounted to the vehicle, said second actuator being connected to said coupling member and adapted to pivot said coupling member with respect to the vehicle.

4. The assembly according to claim 3, wherein said second actuator is mounted on a bracket that is adapted to be mounted to the vehicle, said bracket having arms with terminal ends, said terminal ends being pivotally joined to said coupling member about a first axis, said second actuator being pivotally joined to said coupling member about a second axis, said first axis being parallel to and offset from said second axis.

5. The assembly according to claim 3, wherein said coupling member is configured to pivot about an axis by at least ±15 degrees from center.

6. The assembly according to claim 3, wherein said second actuator is configured to provide at least 5 Nm of torque.

7. The assembly according to claim 1, further comprising a control device adapted to be mounted within the vehicle and configured to control movement of said first actuator.

8. The assembly according to claim 7, wherein said control device further configured to control said motor.

9. The assembly according to claim 1, wherein said first actuator is a linear actuator.

10. The assembly according to claim 1, wherein said first actuator includes a movably piston having an end connected to said duct assembly.

11. The assembly according to claim 1, wherein said motor includes a gearbox having a planetary gearhead.

12. The assembly according to claim 1, wherein said duct comprises an outer duct ring, an inner shaft, and a plurality of fins connecting said outer duct ring to said inner shaft.

13. The assembly according to claim 12, wherein said outer duct ring extends about a perimeter of said propeller, said outer duct ring being generally tubular in shape and having a hydro-dynamically efficient cross-sectional shape.

14. The assembly according to claim 12, wherein said fins have a skewed surface adjacent said inner shaft which acts as a means for counteracting torque resulting from forces produced by said propeller on a fluid flowing therethrough.

15. The assembly according to claim 1, wherein said duct assembly is configured to pivot about an axis by at least ±15 degrees from center.

16. The assembly according to claim 1, wherein said first actuator is configured to provide at least 5 Nm of torque.

17. An assembly for an underwater vehicle, said assembly comprising:

a motor;

a duct assembly including a duct and a propeller mounted within said duct, said propeller being configured to be driven by said motor;

a first actuator adapted to be connected to the vehicle, said first actuator being connected to said duct assembly and adapted to pivot said duct assembly with respect to the vehicle; and a coupling member adapted to be mounted to the vehicle and configured to pivotally receive a portion of said duct assembly, said duct assembly being configured to pivot within said coupling member, wherein said coupling member is mounted to an insulation housing that is adapted to be mounted within the vehicle.

18. An assembly for an underwater vehicle, said assembly comprising:

a motor;

a duct assembly including a duct and a propeller mounted within said duct, said propeller being configured to be driven by said motor;

a first actuator adapted to be connected to the vehicle, said first actuator being connected to said duct assembly and adapted to pivot said duct assembly with respect to the vehicle; and a coupling member adapted to be mounted to the vehicle and configured to pivotally receive a portion of said duct assembly, said duct assembly being configured to pivot within said coupling member, wherein said duct assembly further comprises a coupling body having a generally truncated, conical shape, said coupling body having a hollow interior portion configured to receive said motor, said motor having a drive shaft extending from said interior portion through an aperture in an end portion of said coupling body, said drive shaft being coupled to said propeller, said coupling body having an outer surface with a first section comprising said portion of said duct assembly received by said coupling member and a second section configured to receive said duct.

19. An underwater vehicle comprising:

a vehicle body;

a motor;

a duct assembly including a duct and a propeller mounted within said duct, said propeller being configured to be driven by said motor;

a first actuator connected to said vehicle body, said first actuator being connected to said duct assembly and configured to pivot said duct assembly with respect to said vehicle body; and a coupling member mounted to said vehicle body and configured to pivotally receive a portion of said duct assembly, wherein said coupling member is joined to said portion of said duct assembly by at least one pin such that said duct assembly is pivotable about a first axis, and wherein said coupling member is mounted to said vehicle body by at least one pin such that said coupling member is pivotable about a second axis, said second axis being perpendicular to said first axis.

20. The underwater vehicle according to claim 19, further comprising:

a second actuator mounted to said vehicle body, said second actuator being connected to said coupling member and adapted to pivot said coupling member with respect to said vehicle body.

21. The underwater vehicle according to claim 19, wherein said vehicle body is autonomous.

22. An assembly for an underwater vehicle, said assembly comprising:

a motor;

a duct assembly including a duct and a propeller, said duct having a generally cylindrical shape oriented about a longitudinal axis, said propeller having an axis of rotation, said propeller being mounted within said duct and configured to be driven by said motor, said propeller and said duct being connected such that said axis of rotation of said propeller and said longitudinal axis of said duct have a fixed orientation with respect to one another;

means for changing an orientation of said axis of rotation of said propeller and said longitudinal axis of said duct with respect to the vehicle; and a coupling member adapted to be mounted to the vehicle and configured to pivotally receive a portion of said duct assembly, wherein said coupling member is joined to said portion of said duct assembly by at least one pin such that said duct assembly is pivotable about a first axis, and wherein said coupling member is adapted to be mounted to the vehicle by at least one pin such that said coupling member is pivotable about a second axis, said second axis being perpendicular to said first axis.

23. The assembly according to claim 22, wherein said means for changing an orientation comprises a first actuator adapted to be connected to the vehicle, said first actuator being connected to said duct assembly.

24. The assembly according to claim 23, wherein said means for changing an orientation further comprises a second actuator adapted to be mounted to the vehicle, said second actuator being connected to said coupling member and adapted to pivot said coupling member with respect to the vehicle.

25. The assembly according to claim 24, wherein said first actuator is adapted to be connected to the vehicle via a member rigidly mounted to said coupling member.

26. The assembly according to claim 24, wherein said second actuator is mounted on a bracket that is adapted to be mounted to the vehicle, said bracket having arms with terminal ends, said terminal ends being pivotally joined to said coupling member about a first axis, said second actuator being pivotally joined to said coupling member about a second axis, said first axis being parallel to and offset from said second axis.

27. The assembly according to claim 24, wherein:

said duct assembly is configured to pivot about an axis by at least ±15 degrees from center; and said coupling member is configured to pivot about an axis by at least ±15 degrees from center.

28. The assembly according to claim 22, wherein said duct comprises an outer duct ring, an inner shaft, and a plurality of fins connecting said outer duct ring to said inner shaft.

29. The assembly according to claim 28, wherein said outer duct ring extends about a perimeter of said propeller, said outer duct ring being generally tubular in shape and having a hydro-dynamically efficient cross-sectional shape.

30. The assembly according to claim 28, wherein said fins have a skewed surface adjacent said inner shaft which acts as a means for counteracting torque resulting from forces produced by said propeller on a fluid flowing therethrough.

31. An assembly for an underwater vehicle, said assembly comprising:

a motor;

a duct having a generally cylindrical shape oriented about a longitudinal axis;

a propeller having an axis of rotation, said propeller being mounted within said duct and configured to be driven by said motor, said propeller and said duct being connected such that said axis of rotation of said propeller and said longitudinal axis of said duct have a fixed orientation with respect to one another; and means for changing an orientation of said axis of rotation of said propeller and said longitudinal axis of said duct with respect to the vehicle, wherein said duct and said propeller are part of a duct assembly, and said means for changing an orientation comprises a first actuator adapted to be connected to the vehicle, said first actuator being connected to said duct assembly, further comprising a coupling member adapted to be mounted to the vehicle and configured to pivotally receive a portion of said duct assembly, and wherein said means for changing an orientation further comprises a second actuator adapted to be mounted to the vehicle, said second actuator being connected to said coupling member and adapted to pivot said coupling member with respect to the vehicle, wherein said duct assembly further comprises a coupling body having a generally truncated, conical shape, said coupling body having a hollow interior portion configured to receive said motor, said motor having a drive shaft extending from said interior portion through an aperture in an end portion of said coupling body, said drive shaft being coupled to said propeller, said coupling body having an outer surface with a first section comprising said portion of said duct assembly received by said coupling member and a second section configured to receive said duct.

32. An underwater vehicle comprising:

a vehicle body;

a motor;

a duct assembly including a duct and a propeller, said duct having a generally cylindrical shape oriented about a longitudinal axis, said propeller having an axis of rotation, said propeller being mounted within said duct and configured to be driven by said motor, said propeller and said duct being connected such that said axis of rotation of said propeller and said longitudinal axis of said duct have a fixed orientation with respect to one another;

means for changing an orientation of said axis of rotation of said propeller and said longitudinal axis of said duct with respect to said vehicle body; and a coupling member mounted to said vehicle body and configured to pivotally receive a portion of said duct assembly, wherein said coupling member is joined to said portion of said duct assembly by at least one pin such that said duct assembly is pivotable about a first axis, and wherein said coupling member is mounted to said vehicle body by at least one pin such that said coupling member is pivotable about a second axis, said second axis being perpendicular to said first axis.

33. The underwater vehicle according to claim 32, wherein said vehicle body is autonomous.

34. An underwater vehicle comprising:

a vehicle body;

a motor;

a duct assembly including a duct and a propeller mounted within said duct, said propeller being configured to be driven by said motor;

a first actuator connected to said vehicle body, said first actuator being connected to said duct assembly and configured to pivot said duct assembly with respect to said vehicle body; and a coupling member mounted to said vehicle body and configured to pivotally receive a portion of said duct assembly, said duct assembly being configured to pivot within said coupling member, wherein said coupling member is mounted to an insulation housing that is mounted within said vehicle body.

35. An assembly for an underwater vehicle, said assembly comprising:

a motor;

a duct assembly including a duct and a propeller, said duct having a generally cylindrical shape oriented about a longitudinal axis, said propeller having an axis of rotation, said propeller being mounted within said duct and configured to be driven by said motor, said propeller and said duct being connected such that said axis of rotation of said propeller and said longitudinal axis of said duct have a fixed orientate with respect to one another;

means for changing an orientation of said axis of rotation of said propeller and said longitudinal axis of said duct with respect to the vehicle;

a coupling member adapted to be mounted to the vehicle and configured to pivotally receive a portion of said duct assembly, wherein said coupling member is mounted to an insulation housing that is adapted to be mounted within the vehicle.

36. An underwater vehicle comprising:

a vehicle body;

a motor;

a duct assembly including a duct and a propeller, said duct having a generally cylindrical shape oriented about a longitudinal axis, said propeller having an axis of rotation, said propeller being mounted within said duct and configured to be driven by said motor, said propeller and said duct being connected such that said axis of rotation of said propeller and said longitudinal axis of said duct have a fixed orientation with respect to one another; and means for changing an orientation of said axis of rotation of said propeller and said longitudinal axis of said duct with respect to said vehicle body; and a coupling member adapted to be mounted to said vehicle body and configured to pivotally receive a portion of said duct assembly, wherein said coupling member is mounted to an insulation housing that is mounted within said vehicle body.

* * * * *